United States Patent [19]

Saunders

[11] 4,034,523

[45] July 12, 1977

[54] GRAFFITI PROTECTION

[76] Inventor: Reginald E. Saunders, 620 W. Diamond St., Philadelphia, Pa. 19122

[21] Appl. No.: 618,786

[22] Filed: Oct. 2, 1975

[51] Int. Cl.[2] ..... G09B 1/00; G09F 11/02

[52] U.S. Cl. ..... 52/29; 35/77; 40/77.4; 46/37

[58] Field of Search ..... 52/29, 31, 100; 35/77; 46/37; 40/77.4, 77.6, 77.7, 125 K

[56] References Cited

U.S. PATENT DOCUMENTS

| | | | |
|---|---|---|---|
| 1,173,361 | 2/1916 | Lean | 40/77.7 |
| 1,752,251 | 3/1930 | Giroux | 40/28 C |
| 2,581,492 | 1/1952 | Lowe et al. | 46/37 X |
| 2,647,335 | 8/1953 | Andersson | 40/77.7 |
| 2,887,085 | 5/1959 | Aiken | 40/77.6 X |
| 2,902,726 | 9/1959 | Berreshi | 52/311 |
| 3,310,025 | 3/1967 | Egner | 40/77.6 |
| 3,365,841 | 1/1968 | Barnett | 52/303 X |
| 3,410,011 | 11/1968 | Bowman | 40/77.6 |
| 3,706,148 | 12/1972 | Johnston | 40/77.7 |

FOREIGN PATENT DOCUMENTS

| | | | |
|---|---|---|---|
| 137,802 | 10/1901 | Germany | 40/77.6 |
| 476,586 | 5/1929 | Germany | 40/77.6 |

*Primary Examiner*—Leslie Braun
*Attorney, Agent, or Firm*—Weiser, Stapler & Spivak

[57] ABSTRACT

Surfaces are protected from graffiti by panels of rotatable rollers. The rollers are rotated in random patterns to scramble or conceal graffiti. The rollers are removed for cleaning.

5 Claims, 4 Drawing Figures

GRAFFITI PROTECTION

This invention relates to the protection of surfaces, such as the sides of buildings or other structures, from unwanted markings, commonly referred to as "graffiti".

In recent times, there has been an enormous upswing in the frequency with which graffiti are applied to all sorts of structures.

Efforts to combat this phenomenon have taken primarily two directions.

One is the development of techniques and substances of greater effectiveness in removing the graffiti. The other is the treatment of the surfaces in a manner which makes them less susceptible to adhesion of the paints used for graffiti and which makes these paints easier to remove once applied.

Neither of these approaches has been completely successful, as attested by the continued prevalence of the problem.

Removal techniques are very costly and time-consuming, and generally still leave conspicuous traces of either the material which it was desired to remove, or of the treatment itself.

Protective treatments are likewise very costly, and have not proven highly effective, in any event. Also, they tend to need frequent renewal, which increases their burdensomeness.

Accordingly, it is a primary object of this invention to provide a new and improved technique for protecting surfaces from graffiti.

It is another object to provide such a technique which is free from certain other drawbacks of the prior art.

It is a further object to provide apparatus for protecting structures from graffiti which is easy to use.

It is a further object to provide such apparatus which is easy to maintain.

It is a still further object to provide a method for using such apparatus which is effective and convenient.

These and other objects which will appear are achieved in accordance with the invention by providing a panel-like structure in front of the surface to be protected. This protective structure is formed of generally cylindrical, roller-like elements. These rollers intercept paint which might otherwise be applied to the structure being protected. Rotation of the rollers either conceals from view, or at least scrambles any pattern formed by such paint. The rollers are removable for cleaning or replacement.

For further details, reference is made to the discussion which follows, in the light of the accompanying drawings wherein.

Figure 1:
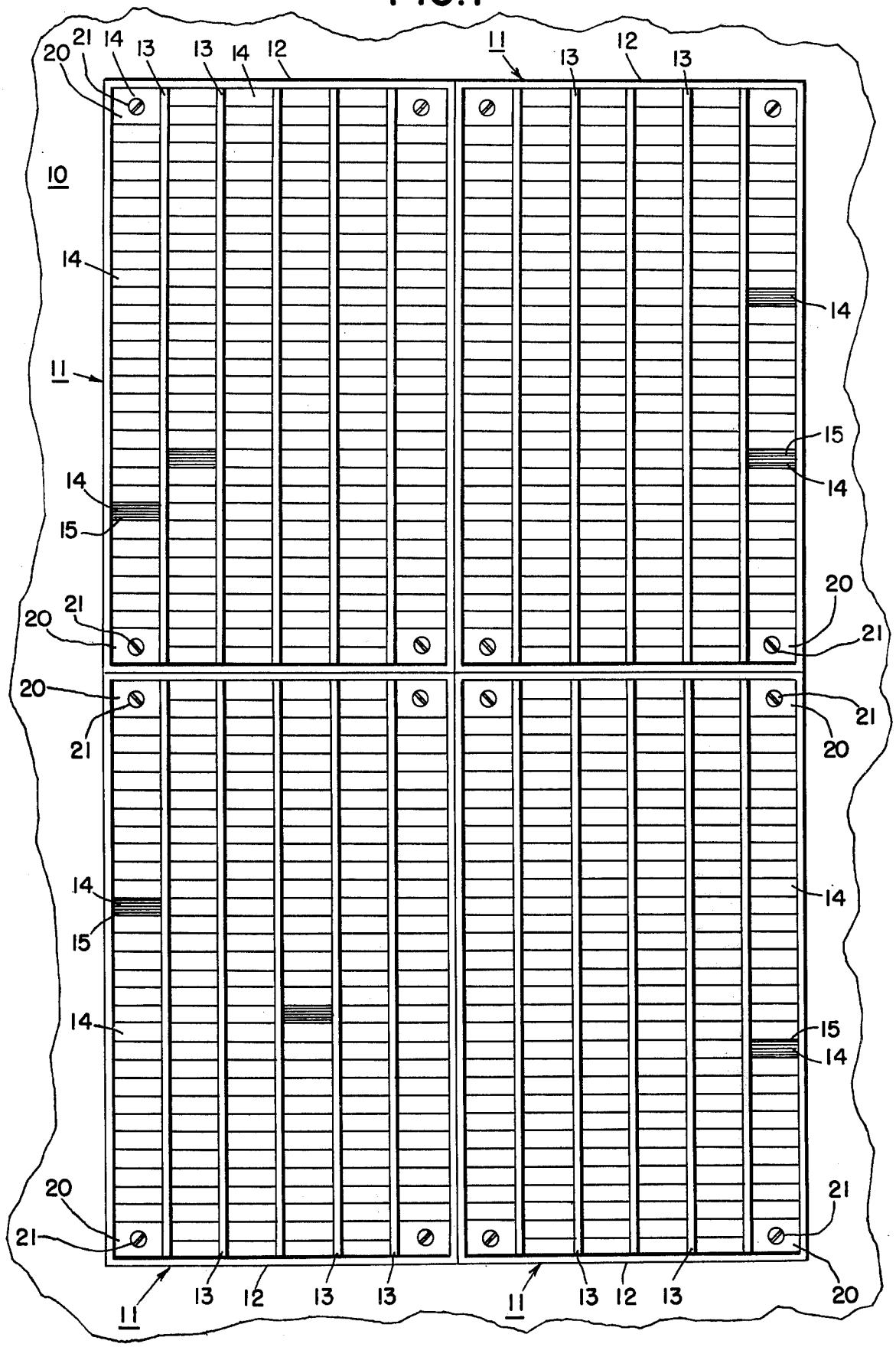
FIG. 1 shows a front elevation view of apparatus embodying the invention.

The same reference numerals are used in the several figures to designate similar elements. Referring to FIG. 1, this shows a fragment 10 of a structure whose surface is to be protected from graffiti in accordance with the present invention. This structure may be the side of a building or any other object in danger of defacing by graffiti.

In accordance with my present invention, there is mounted in front of the surface to be protected an assembly 11 comprising an outer frame 12 within which are positioned dividing members 13. Cylindrical rollers 14 are supported between adjacent dividing members 13, or between such a dividing member 13 and the other frame 12.

Figure 2:
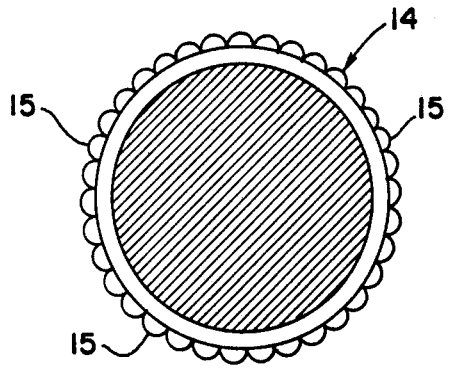
FIG. 2 shows an end view of a roller forming part of the apparatus of FIG. 1.

FIG. 2 shows an end view a typical one of rollers 14. This roller is seen to preferably have a surface 15, corrugated lengthwise, and to be otherwise of generally cylindrical configuration.

Figure 3:
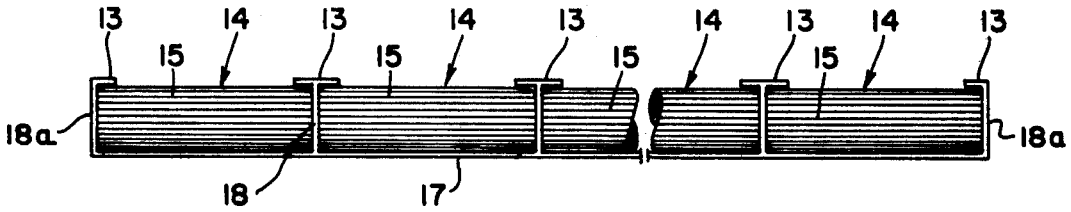
FIGS. 3 and 4 show top views of two alternative embodiments of certain portions of the apparatus of FIG. 1.

FIG. 3 shows the manner in which rollers 14 of FIGS. 1 and 2 are mounted to form panel 11 of FIG. 1. To a backing plate 17, which is not visible in FIG. 1 but which extends behind the entire panel 11 shown in FIG. 1, there are attached protruding channel members 18. These channel members 18 are spaced apart by the length of a roller and are of I-shaped cross-section. The end channels 18*a* at each end of the series of channel members 18 are not I-shaped but U-shaped, as indicated in FIG. 3. The end portions of channels 18 and 18*a* constitute the separating members 13 visable in FIG. 1.

As shown in FIG. 3, where one row of rollers 14 has been shown in its intended position, these rollers are inserted in the space between adjoining channel members 18 and/or 18*a* and are retained within these channel members for rotation by the flanges of the I- or U-shaped channel members previously noted.

Reverting to FIG. 1, it will be seen that this represents an assembly in which the entire panel 11 is filled with rollers 14. In that condition it is positioned in front of the surface 10 to be protected from graffiti.

Ears 20 connected to the frame 12 may be provided for attaching panel 11 to the surface 10 to be protected, using bolts 21 passing through these ears.

As is apparent from FIG. 1, the panel 11 may be of so-called modular construction consisting of two separate frames 12, positioned and attached one above the other in this particular case in order to form a protection for a surface of suitable area. It will also be understood that additional modular sections may be attached next to the ones shown to form a protective structure of any desired dimensions.

The dimensions of the individual rollers 14 may also be varied to suit.

Preferably these rollers are of the order of one-half to one inch in diameter and between three and six inches in axial length.

The rollers 14 may be formed of a variety of materials, preferably inexpensive ones, such as plastic or aluminum. Their surfaces may be treated to be resistant to the application of paint or to facilitate the removal of paint by conventional paint-removing techniques.

In use, a panel embodying the present invention, if defaced with graffiti, is used to diminish the potentially objectionable character of such graffiti in one of or both of two ways. In either case, the rollers 14 constituting the panel are rotated. This may be done either to an extent sufficient to turn their defaced sides away from view, thereby in effect concealing the graffiti from view and having the same effect insofar as the visual impression is concerned as if the graffiti had been completely removed.

The other way is to rotate the affected rollers to varying degrees and more or less randomly, thereby breaking up the pattern formed by the graffiti. The latter is particularly desirable when the graffiti form a particularly obnoxious pattern, such as foul language or obscene pictures.

In either case, the rotation of the rollers may be readily accomplished by hand from the exposed surface of the panel. This completely eliminates costly rotating apparatus and is particularly effective when random rotation to disrupt the graffiti pattern is desired. To that end it suffices to randomly touch the exposed surfaces of the rollers and impart to different ones varying degrees of rotation by moving the hand up or down in an irregular pattern across that surface.

For more permanent removal of the graffiti the rollers can be cleaned either in situ or removed from the positions in the assembly and dipped in cleaning fluid or otherwise treated for paint removal. In this respect, too, the invention is particularly advantageous since it provides detachable surface elements which can be conveniently individually cleaned. During the period that these elements are absent for cleaning, fresh rollers can be positioned in their place so that uninterrupted protection is provided.

Figure 4:
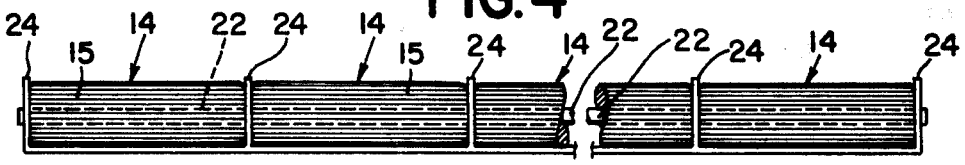

It will be understood that many modifications will occur to those skilled in the art without departing from the inventive concept. For example, the individual rollers 14 may be retained in the panel assembly by means of shafts 22, as shown in FIG. 4. In that case, an appropriate hole for passage of this shaft (not shown) has to be provided in each end surface of each of the rollers 14 shown in FIG. 2. Also, in that case, the separating members between adjacent rollers need not be of I-shaped or U-shaped form, but can be simple separating partitions 24 as shown in FIG. 4. They, too, must of course be provided with suitable holes for the passage of shafts 22.

To provide for alternative mounting of the rollers in the manners shown in FIGS. 3 and 4, respectively, there may be manufactured only one type of roller provided with shaft-receiving holes at both ends and these can then be used interchangeably in the type of embodiments of FIGS. 3 and 4.

I claim:

1. Apparatus for protecting surfaces from graffiti comprising:

a plurality of rollers positioned adjacent each other and being individually rotatable to expose different portions of their surfaces;

said rollers being adapted to be positioned and maintained in position before the surface to be protected;

said rollers being of size and number to cover substantially the entire surface to be protected; wherein the rollers are mounted in a frame constructed and arranged to be positioned in front of the surface to be protected, said apparatus comprising means to prevent axial movement of the rollers within the frame;

said rollers being mounted in the frame in a plurality of columns positioned side by side, said columns being defined by channel members, said channel members being secured to the frame;

wherein at least some of the channel members being spaced apart by the length of a roller.

2. The apparatus of claim 1 wherein the rollers extend axially in side by side juxtaposition within the frame.

3. The apparatus of claim 1 wherein at least some of the rollers are mounted removably between a pair of said channel members.

4. The apparatus of claim 1 wherein the frame has a backing panel positioned between the rollers and the surface to be protected, said backing panel covering the said surface.

5. The apparatus of claim 1 wherein the channel members are I-shaped in cross section and include a web and an end portion and wherein the end portion overlies part of a roller and is contacted by the roller to retain the roller within the frame.

* * * * *